US005722115A

United States Patent [19]

Arens

[11] Patent Number: 5,722,115

[45] Date of Patent: Mar. 3, 1998

[54] DOOR KNOB RECEPTACLE

[76] Inventor: Richard Arens, 6 Oasis Pl., East Northport, N.Y. 11731

[21] Appl. No.: 568,264

[22] Filed: Dec. 6, 1995

[51] Int. Cl.[6] ..... E05C 19/02; E05C 17/00; E05F 5/06

[52] U.S. Cl. ..... 16/85; 292/DIG. 19

[58] Field of Search ..... 16/86 A, 86 R, 16/82, 85; 292/341.12, DIG. 2, DIG. 19

[56] References Cited

U.S. PATENT DOCUMENTS

| | | | |
|---|---|---|---|
| 324,170 | 2/1885 | Owens | D8/402 |
| 1,889,681 | 11/1932 | Marshall et al. | 16/85 |
| 1,931,695 | 10/1933 | Hall | 16/85 |
| 2,577,507 | 12/1951 | Bergdorf | 16/85 |
| 3,103,378 | 9/1963 | Ahlgren | 16/85 |
| 3,133,758 | 5/1964 | Wells | 16/85 |
| 3,386,125 | 6/1968 | Hand . | |
| 3,758,141 | 9/1973 | Weinberger | 16/82 |
| 5,339,492 | 8/1994 | Billew | 16/82 |

*Primary Examiner*—Daniel W. Howell
*Assistant Examiner*—Donald M. Gurley
*Attorney, Agent, or Firm*—Goldstein & Associates

[57] ABSTRACT

A door knob receptacle for receiving and retaining a door knob of a door within a pocket created in a wall by installation of the door knob receptacle thereon, comprising a hemispherical shell having an inner periphery and an outer periphery, a rectangular flange having a front and a rear, which surrounds the outer periphery, self-adhesive tape which is secured to the rear of the rectangular flange, and securing structure such as semi-rigid brushes disposed around and extending inward from the inner periphery of the hemispherical shell towards the center of the hemispherical shell in such a manner that a gap is formed in the center of the semi-rigid brush arrangement.

3 Claims, 1 Drawing Sheet

DOOR KNOB RECEPTACLE

BACKGROUND OF THE INVENTION

The invention relates to a door knob receptacle. More particularly, the invention relates to a hemispherical shell having a rectangular flange around its outer edge so that said hemispherical shell may be placed within a cut-out in a typical sheet-rock wall, thus providing a recessed well or pocket for a door knob to fit within.

Typically, interior doors (and to some extent exterior doors as well) are secured and hung within a door frame such that if the door is opened quickly and with excessive force, said door will travel past a point where it is parallel to the wall behind it, thus allowing the door knob of the door to contact said wall, resulting in damage to the wall. Common resultant damage is a large hole being punched in said wall, leaving an unsightly and unfinished appearance.

In order to repair this damage caused by a door being thrust open, a complex and timely process of cutting out a section of wall and then meticulously replacing it with new sheet-rock, followed by fresh spackle and a fresh coat of paint, ensues. Once remedied, the repaired wall is still susceptible to the same damage upon the next instance of the door being opened with excessive force.

Various references in the art disclose means intended to combat this problem. Large hard plastic or rubber bumpers, for instance, such as those disclosed in U.S. Pat. Nos. 3,386,125 and 324,170 contemplate the securement of these devices to the face of the wall behind the door. These devices fail to provide adequate protection against damage to the wall, since a door which is opened with excessive force such that the door knob contacts the bumper with great momentum will still manage to fracture the area surrounding the wall to which the bumper is secured. Furthermore, due to the bumpers hard, resilient nature, a door knob which contacts said bumper due to a door being opened with excessive force might accidentally rebound back open, injuring an individual in the vicinity of the door way. Finally, due to the great size and mass of the bumper, it prevents a door from traveling its full path and opening as wide as it had before installation of the device.

Other devices, such as high compression springs which extend perpendicular to the surface of the wall behind the door have also been employed in the past. Such devices are similarly ineffective in that they also fail to prevent damage to the area of the wall to which they are secured. Furthermore, these devices pose even a greater danger that upon opening a door, it may contact said spring with such great force that the door is projected back at the individual opening it, injuring such person.

One last downside to these devices in the art is that they have no ability to cause an opened door to remain fixed in an open position. They strive to provide only the single, marginally effective purpose of preventing a door knob from damaging the wall behind the door.

While these units may be suitable for the particular purpose employed, or for general use, they would not be as suitable for the purposes of the present invention as disclosed hereafter.

SUMMARY OF THE INVENTION

It is an object of the invention to produce a door knob receptacle which prevents a door knob from damaging a wall surface located immediately behind said door.

It is another object of the invention to produce a door knob receptacle which is capable of quickly and easily being installed upon a wall in response to previous damage caused by a door knob, or as a precautionary measure before any damage occurs as a result thereof.

It is a further object of the invention to produce a door knob receptacle which forms a recessed well or pocket within a wall, allowing a door knob to fit within said well or pocket and thus permitting a door to open wider than normal, past its usual maximum travel distance.

It is a still further object of the invention to produce a door knob receptacle which prevents a door which has been thrust open with excessive force from rebounding back towards an individual who may be present in the door way.

It is yet a further object of the invention to provide a door knob receptacle capable of containing a door knob such that the door to which the door knob is secured remains in a stationery, open position.

The invention is a door knob receptacle for receiving and retaining a door knob of a door within a pocket created in a wall by installation of the door knob receptacle thereon, comprising a hemispherical shell having an inner periphery and an outer periphery, a rectangular flange having a front and a rear, which surrounds said outer periphery, self-adhesive tape which is secured to the rear of the rectangular flange, and securing means such as semi-rigid brushes disposed around and extending inward from the inner periphery of the hemispherical shell towards the center of said hemispherical shell in such a manner that a gap is formed in the center of said semi-rigid brush arrangement.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
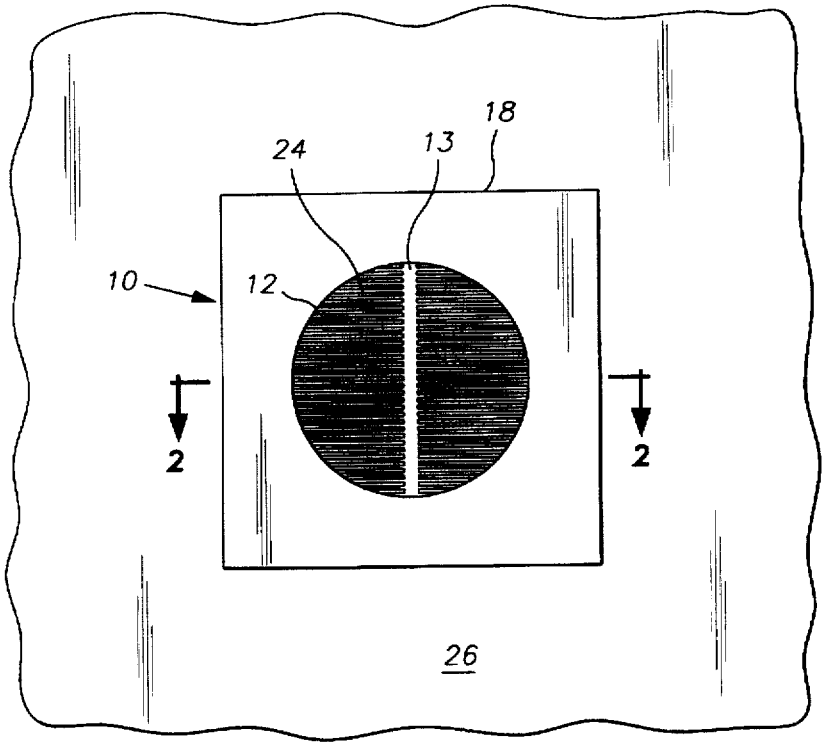
FIG. 1 is a front view of the instant invention installed upon a wall.
Figure 2:
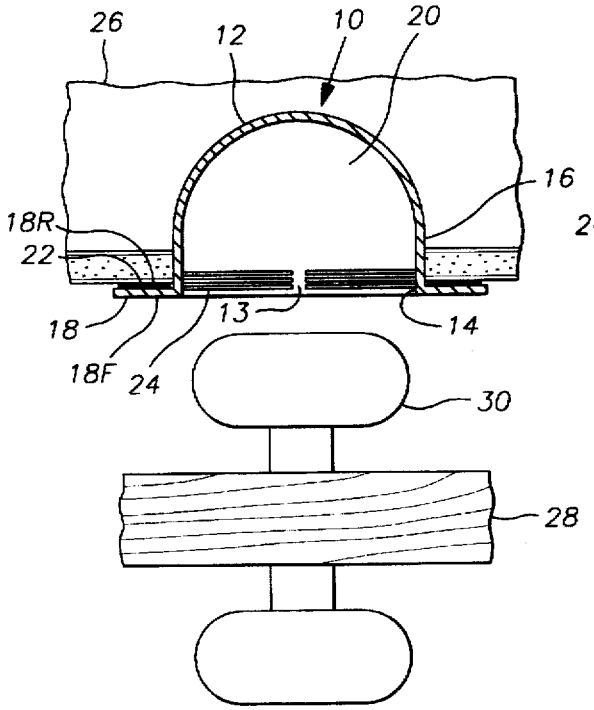
FIG. 2 is a top plan view of the instant invention, taken on line 2—2 of FIG. 1, installed upon a wall, with a door and door knob also illustrated thereat.

FIG. 1 illustrates the instant invention, a door knob receptacle 10, installed upon a wall 26. As seen in FIG. 2, the door knob receptacle 10 comprises a hemispherical shell 12. The hemispherical shell 12 has an inner periphery 14 and an outer periphery 16. A rectangular flange 18 surrounds the outer periphery 16 of the hemispherical shell 12, and has a front 18F and a rear 18R. Self-adhesive tape 22 is secured to the rear 18R of the rectangular flange 18. Securing means, such as semi-rigid brushes 24, are disposed around and extend from the inner periphery 14 of the hemispherical shell 12 inward, towards the center of said hemispherical shell 12 in such a manner that a gap 13 is formed in the center of the semi-rigid brush arrangement, as seen in FIG. 1. Said securing means can also comprise semi-rigid strips of plastic or rubber. In the preferred embodiment, said semi-rigid brushes 24 extend horizontally from the inner periphery 14 of the hemispherical shell 12, parallel to each other, thus causing the gap 13 to extend vertically in the center of said hemispherical shell 12. Such an embodiment is preferred so that non-traditional door knobs such as French door knobs which typically are rectangular and extend horizontally parallel to the face of the door 28 (thus perpendicular to the gap 13 which would be present in the preferred embodiment) can be retained within the hemispherical shell 12 without slipping through the gap 13 in the semi-rigid brushes 24 or other securing means employed.

Shown further in FIG. 2 is a door 28, with a door knob 30 secured thereto. The door knob 30 should be interpreted to include any type of door handle or similar mechanism fastened to a door 28 and used for opening and closing said door 28. Often, prior to the installation of the door knob receptacle 10, a door 28 which is forced open with excessive force can travel past its normal maximum travel length, thus allowing the door knob 30 to fracture or punch a hole in the wall 26 behind said door 28. The resulting damage is quite unsightly and can result in drafts or energy loss via the hole in the wall 26. Accordingly, the door knob receptacle 10 can be installed upon the wall 26 to repair damage previously inflicted thereupon.

FIG. 1 illustrates the door knob receptacle 10 installed upon the wall 26. When installing the door knob receptacle 10 upon the wall 26 to repair previous damage such as a fracture or hole, the damaged area is trimmed to a size which is larger than the diameter of the hemispherical shell 12, yet smaller than the rectangular flange 18. When installing the door knob receptacle 10 upon the wall 26 to prevent damage rather than to remedy existing damage, a hole is cut in the wall 26 which is again larger than the diameter of the hemispherical shell 12, yet smaller than the rectangular flange 18. Referring again to FIG. 2, it should be noted that under either installation method, the hemispherical shell 12 is then inserted into the hole such that the rectangular flange 18 presses up against the surface of the wall 26. The self-adhesive tape 22 which is fastened to the rear 18R of the rectangular flange 18 secures said rectangular flange 18 to the wall 26. Once installed, the door knob receptacle 10 forms a pocket 20 within the wall 26. Said pocket 20 can also be defined as a recess or well.

Figure 3:
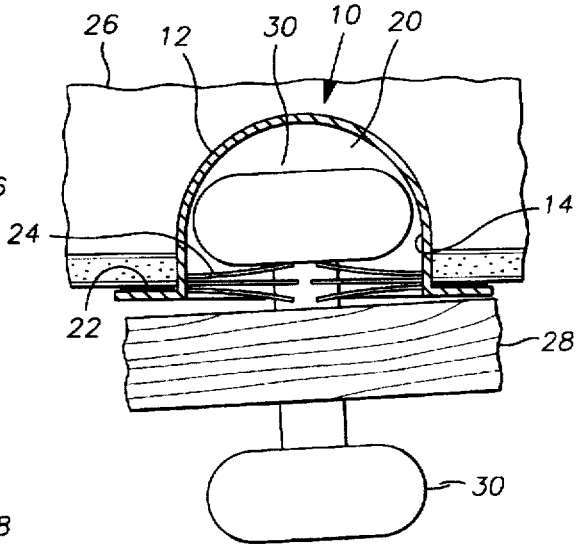
FIG. 3 is a top plan view of the instant invention installed upon a wall, with a door knob retained therein.

Installed upon the wall 26, the door knob receptacle 10 serves several functions, which can be seen best by reference to FIG. 3. Primarily, the door knob receptacle 10 disguises previous damage and prevents further damage to the wall 26 by providing a pocket 20 within which the door knob 30 is retained. The brushes 24 or other securing means which are disposed about the inner periphery 14 of the hemispherical shell 12 serve to absorb the impact of the door knob 30 in the event that the door 28 is forced open quickly and with excessive force. By absorbing the impact of the door knob 30, the brushes 24 prevent the door knob 30 from violently contacting the hemispherical shell 12 and thus causing damage or stress to the wall 26. Furthermore, the brushes 24 have the further effect of preventing the door 28 from rebounding back towards and potentially injuring a person opening said door 28. Also, the brushes 24 or other securing means employed function to retain the door knob 30 within the pocket 20, thus causing the door 28 to remain in a stationery open position without the aid of a door stopper or similar object. Finally, by allowing the door knob 30 to enter the pocket 20 formed by the door knob receptacle 10, said door knob receptacle 10 allows the door 28 to open beyond its normal point of travel, as illustrated best in FIG. 3.

What is claimed is:

1. A door knob receptacle for receiving and retaining a door knob of a door within a pocket created in a wall, comprising:

a) a hemispherical shell having an outer periphery and an inner periphery;

b) a rectangular flange disposed about the outer periphery of said hemispherical shell, the rectangular flange having a front and a rear, wherein self adhesive tape is affixed to the rear of the rectangular flange; and c) securing means disposed about the inner periphery of the hemispherical shell, said securing means comprising semi-rigid brushes disposed around and extending from the inner periphery of the hemispherical shell inward toward the center of said hemispherical shell in such a manner that a gap is formed in the center of said semi-rigid brush arrangement, thus allowing the door knob to enter the pocket and be retained therein.

2. A door knob receptacle for receiving and retaining a door knob of a door within a pocket created in a wall, comprising:

a) a hemispherical shell having an outer periphery and an inner periphery;

b) a rectangular flange disposed about the outer periphery of said hemispherical shell, the rectangular flange having a front and a rear, wherein self adhesive tape is affixed to the rear of the rectangular flange; and c) securing means disposed about the inner periphery of the hemispherical shell, said securing means comprising semi-rigid brushes disposed around and extending from the inner periphery of the hemispherical shell inward toward the center of said hemispherical shell in such a manner that a gap is formed in the center of said semi-rigid brush arrangement, said semi-rigid brushes extending horizontally from the inner periphery of the hemispherical shell, parallel to each other, thus causing the gap formed thereby to extend vertically in the center of said hemispherical shell, allowing the door knob to enter the pocket and be retained therein.

3. A door knob receptacle for receiving and retaining a door knob of a door within a pocket created in a wall, comprising:

a) a hemispherical shell having an outer periphery and an inner periphery;

b) a flange disposed about the outer periphery of said hemispherical shell, the flange having a front and a rear; and c) securing means disposed about the inner periphery of the hemispherical shell, said securing means comprising semi-rigid brushes disposed around and extending from the inner periphery of the hemispherical shell inward toward the center of said hemispherical shell in such a manner that a gap is formed in the center of said semi-rigid brush arrangement, thus allowing the door knob to enter the pocket and be retained therein.

* * * * *